US007116194B2

(12) United States Patent
Azzola et al.

(10) Patent No.: US 7,116,194 B2
(45) Date of Patent: Oct. 3, 2006

(54) ELECTRIC POLE FOR A LOW-VOLTAGE POWER CIRCUIT BREAKER, AND ASSOCIATED CIRCUIT BREAKER

(75) Inventors: Lucio Azzola, Bergamo (IT); Eligio Zanchi, Alzano Lombardo (IT)

(73) Assignee: ABB Service S.r.L., Milan (IT)

( * ) Notice: Subject to any disclaimer, the term of this patent is extended or adjusted under 35 U.S.C. 154(b) by 240 days.

(21) Appl. No.: 10/496,574

(22) PCT Filed: Dec. 10, 2002

(86) PCT No.: PCT/EP02/14069

§ 371 (c)(1),
(2), (4) Date: May 24, 2004

(87) PCT Pub. No.: WO03/050835

PCT Pub. Date: Jun. 19, 2003

(65) Prior Publication Data

US 2005/0068131 A1 Mar. 31, 2005

(30) Foreign Application Priority Data

Dec. 10, 2001 (IT) ..... MI2001A2586

(51) Int. Cl.
*H01H 13/04* (2006.01)
*H01H 75/00* (2006.01)

(52) U.S. Cl. ..... 335/202; 335/6; 200/303

(58) Field of Classification Search ..... 335/6–46, 335/201, 202; 200/293, 303
See application file for complete search history.

(56) References Cited

U.S. PATENT DOCUMENTS 3,842,376 A * 10/1974 Mune ..... 335/202
4,910,485 A * 3/1990 Bolongeat-Mobleu et al. ..... 335/195
5,298,874 A 3/1994 Morel et al.
6,531,941 B1 * 3/2003 Greenberg et al. ..... 335/202

FOREIGN PATENT DOCUMENTS

EP 0 961 306 A2 12/1999

* cited by examiner

*Primary Examiner*—Ramon M. Barrera
(74) *Attorney, Agent, or Firm*—Connolly Bove Lodge & Hutz; Larry J. Hume

(57) ABSTRACT

An electric pole for a low-voltage power circuit breaker, comprising an insulating enclosure (20, 30) that has a lower wall, an upper wall, two side walls, a rear wall and a front wall, at least one arc chute, at least one fixed contact (8) and at least one moving contact (9) that can be mutually coupled/uncoupled, and a first electric terminal (10) and a second electric terminal (11) that are functionally associated with the fixed contact and the moving contact and allow electrical connection of the pole in input and in output, its particularity consisting of the fact that the insulating enclosure comprises a first half-shell (20) and a second half-shell (30) which are mutually coupled along corresponding coupling surfaces and form a self-supporting structure, the first and second half-shells being shaped so as to form at least one compartment (12) that is suitable to accommodate the fixed contact and the moving contact and the arc chute, and second (13) and third containment volumes (14), which are arranged on mutually opposite sides with respect to the compartment and are suitable to accommodate respectively the first and second electric terminals.

16 Claims, 6 Drawing Sheets

ELECTRIC POLE FOR A LOW-VOLTAGE POWER CIRCUIT BREAKER, AND ASSOCIATED CIRCUIT BREAKER

The present invention relates to an electric pole for a low-voltage power circuit breaker having improved characteristics and to a circuit breaker that uses said pole.

It is known that low-voltage industrial electrical systems, characterized by operating voltages of less than 1000 volts and by electric currents of relatively high nominal value (from fractions of amperes to several thousand amperes), which produce considerable power levels, generally use current disconnection and protection devices, known as automatic power circuit breakers.

Depending on the applications, these devices comprise one or more electric poles, which constitute the interruption section of the circuit breaker; each pole comprises at least one arc chute and two electric contacts, a fixed one and a moving one, which can be mutually coupled/uncoupled; in turn, the contacts are connected electrically to the phase or neutral conductor associated with said pole by virtue of appropriate connection terminals.

Currently, the electrical poles used in industrially employed circuit breakers are available in various constructive embodiments, characterized to varying degrees by modularity and detachability features, and are conceived so as to provide an adequate performance in electrical and mechanical terms. In particular, for the correct operation of the circuit breaker it is fundamentally important that the moving contacts of the various poles be actuated substantially synchronously with each other, and that suitable electrical insulation is ensured among the electrically active parts; furthermore, by virtue of the significant power levels involved, the circuit breaker must be able to withstand adequately the mechanical stresses involved during its working life.

In order to meet these requirements, in known solutions, regardless of the degree of modularity and detachability, the poles are accommodated in an external frame that constitutes the outer enclosure of the circuit breaker and helps to keep the poles mechanically mutually associated and to support structurally the stresses to which said circuit breaker is subjected during its useful life.

In particular, in the case of circuit breakers of the open type (air circuit breaker, ACB), the various poles are arranged side by side and are inserted in an external modular structure, generally formed by a plurality of metallic structural elements that are suitably mutually interconnected, help to keep the poles mechanically associated with each other and constitute the structural support element on which the stresses affecting the circuit breaker during its useful life are discharged.

In the case of enclosed circuit breakers or molded case circuit breakers (MCCB) of the type to which the present invention relates, the components of the various poles are inserted in a box-like enclosure that is configured appropriately and is generally made of plastic, usually structural synthetic resins. Said case is part of the outer enclosure of said circuit breaker and acts both as a containment element, so as to contain and rigidly couple mechanically the various poles to each other, and as a structural element, since it helps to withstand the considerable stresses and vibrations that are discharged onto it during the transition of the device or in case of tripping or short circuit. The outer enclosure of the circuit breaker is then generally completed by using a cover, also made of plastic, which is arranged on the front part of the circuit breaker, so as to cover the actuation elements of the circuit breaker; a lever, available for the manual intervention of operators, protrudes from the cover.

In this type of circuit breaker, a first constructive solution uses a single case that is divided internally into compartments so as to form seats in which the various components of each pole are assembled; in this case, the partitions between the various compartments are shaped so as to allow the passage of a contact supporting shaft that passes through, and affects, the various poles and on which the various moving contacts are mounted; moreover, the entire assembly is conceived so as to ensure adequate electrical insulation among said poles.

A second solution widely used in the art instead entails adopting a two-case constructive architecture. In this instance, the various components of each pole are inserted first of all in a first case generally formed by two half-shells, whose function is essentially to contain the components of each pole; then the cases of the various poles are in turn inserted in a second case, which in this instance also is part of the outer enclosure of the circuit breaker and performs mechanical-structural functions, in a manner similar to the one described above.

In both cases, a critical aspect arises from the use of the outer containment cases, which generally have a complicated and bulky shape and most of all must be manufactured in multiple series that are differentiated by size and number of poles constituting the circuit breaker; this clearly entails the use of several molds and of considerable material, ultimately contributing to an unnecessary and significant increase in production costs. Furthermore, in two-case solutions it is often necessary to use special spacer modules or elements that are inserted in the outer enclosure, for example between two laterally adjacent poles, in order to occupy any free spaces and rigidly couple the poles, keeping them in the correct position.

Moreover, indeed because of the stresses and vibrations that the outer cases have to withstand, these containment elements can be subject to deterioration and deformation; accordingly, it is often necessary to replace the circuit breaker completely or possibly perform difficult and expensive maintenance operations in order to ensure adequate reliability. Clearly this has negative repercussions on the overall manufacturing and operating costs of the circuit breaker.

From the electrical standpoint, if one uses the two-case solution, the inner cases for containing the components of the individual poles must be shaped appropriately so as to be suitable for coupling to the elements on which the moving contacts of each pole are fitted, typically the sections of a contact supporting shaft. For this purpose, said inner cases have lateral openings through which transverse bars pass; said bars pass through the various poles and are meant to transmit the motion among the corresponding moving contacts so as to provide transitions that are as synchronous as possible.

Although this solution allows to transmit motion among the various poles, it requires additional openings in the containment cases, which must be sealed appropriately so that the gases normally generated inside the poles during a short circuit exit only through the venting channels provided for this purpose; to do so, said additional openings require the use of additional appropriately shaped mechanical elements, and this entails an increase in the required constructive components, in the constructive complexity of the entire assembly, and ultimately in the costs.

The aim of the present invention is to provide an electric pole for a low-voltage power circuit breaker that allows to obviate the drawbacks of the prior art and in particular, with respect to the known art, lends itself to be produced in a constructively simplified manner, at the same time ensuring optimum functional performance both electrically and mechanically. Within the scope of this aim, an object of the present invention is to provide an electrical pole for a low-voltage power circuit breaker that has a smaller number of components than the known art and allows to reduce production costs considerably.

Another object of the present invention is to provide an electric pole for a low-voltage power circuit breaker in which the connection among the various elements of said pole and with other poles associated therewith is provided simply and reliably, avoiding complicated joining and assembly operations.

Another object of the present invention is to provide an electric pole for a low-voltage power circuit breaker that is easy to manufacture and at modest costs.

This aim, these objects and others that will become better apparent hereinafter are achieved by an electric pole for a low-voltage power circuit breaker, comprising an insulating enclosure that has a lower wall, an upper wall, two side walls, a rear wall and a front wall, at least one arc chute, at least one fixed contact and at least one moving contact that can be mutually coupled/uncoupled, and a first electric terminal and a second electric terminal that are functionally associated with said fixed contact and said moving contact and allow electrical connection of the pole in input and in output, its particularity consisting of the fact that said insulating enclosure comprises a first half-shell and a second half-shell which are mutually coupled along corresponding coupling surfaces and form a self-supporting structure, said first and second half-shells being shaped so as to form at least one compartment that is suitable to accommodate said fixed contact and said moving contact and said arc chute, and second and third containment volumes, which are arranged on mutually opposite sides with respect to said compartment and are suitable to accommodate respectively said first and second electric terminals.

Further characteristics and advantages will become apparent from the description of preferred but not exclusive embodiments of the electric pole according to the present invention, illustrated only by way of non-limitative example in the accompanying drawings, wherein.

Figure 1:
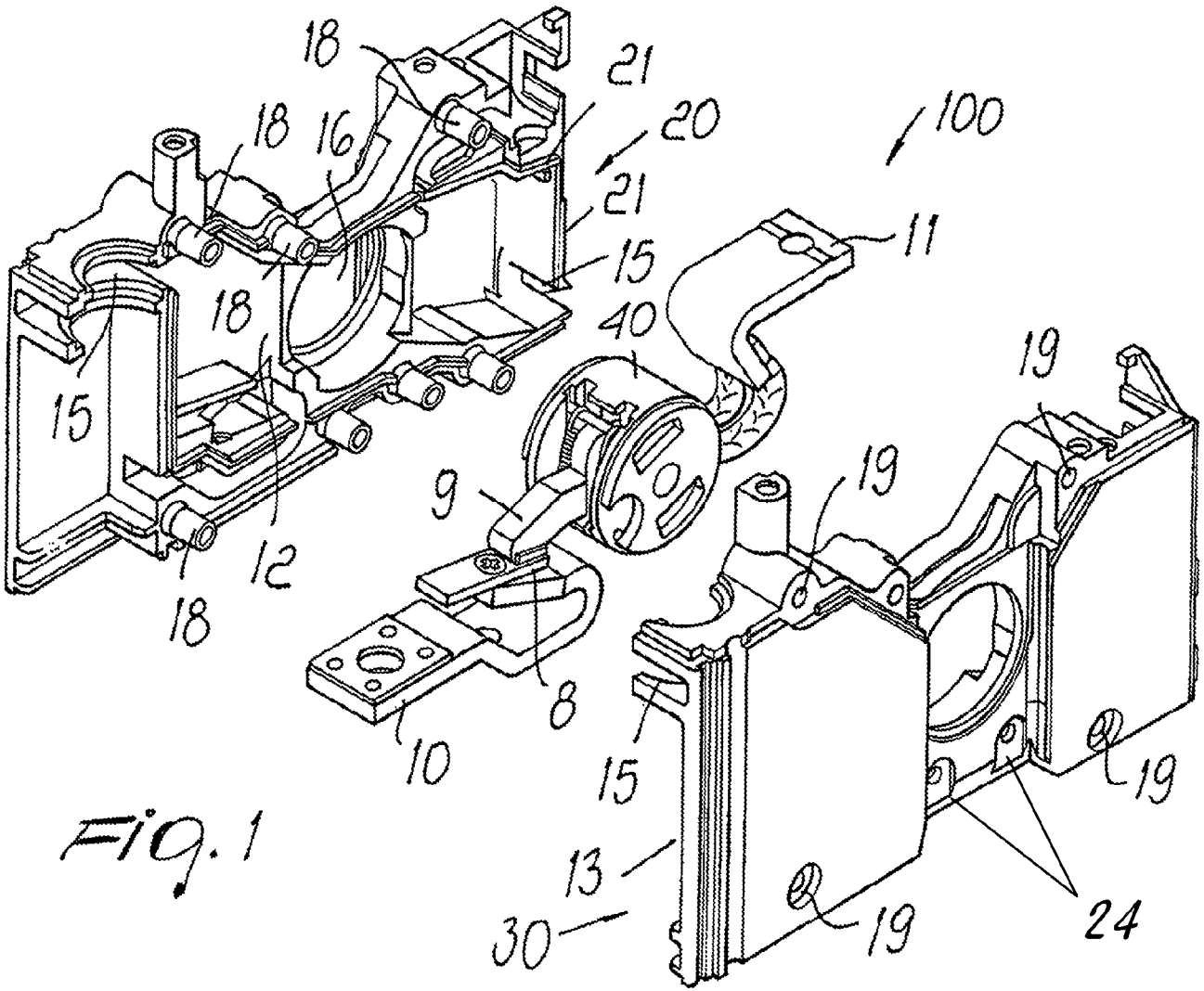
FIG. 1 is a schematic exploded view of an electric pole according to the present invention for a single-break low-voltage power circuit breaker.

With reference to the cited figures, the electric pole for a low-voltage power circuit breaker according to the invention, generally designated by the reference numeral 100, comprises an insulating enclosure 1 which has a lower wall 2, an upper wall 3, two side walls 4 and 5, a rear wall 6 and a front wall 7; inside the enclosure 1 there is at least one arc chute, whose arc quenching plates are not shown, at least one first fixed contact 8 and at least one moving contact 9, which can be mutually coupled/uncoupled, and a first electric terminal 10 and a second electric terminal 11, which are functionally associated with the fixed contact 8 and the moving contact 9 and allow input and output electrical connection with respect to the pole 100, for example to a phase conductor of the circuit in which said pole is inserted.

Advantageously, in the pole 100 according to the invention the insulating enclosure 1 comprises a first half-shell 20 and a second half-shell 30, which are mutually coupled along corresponding coupling surfaces so as to provide a self-supporting structure. Furthermore, the first half-shell 20 and the second half-shell 30 are shaped so as to form when coupled: at least one compartment 12, which is arranged for example substantially centrally and is suitable to accommodate the fixed contact 8 and the moving contact 9 and the arc chute with the corresponding plates; a first containment volume 13, which is arranged at the upper wall 3 and is suitable to accommodate the first electric terminal 10; and a second containment volume 14 that lies opposite the first containment volume 13 relative to the compartment 12, for example at the common edge between the upper front wall 7 and the lower wall 2, which is suitable to accommodate the second electric terminal 11.

If the pole 100 is of the double-break type, as shown for example in FIGS. 2 to 5, a second fixed contact 8 and a second arc chute are used inside the enclosure 1 and are also appropriately accommodated in the compartment 12.

In the embodiments shown in FIGS. 2 to 5, and merely by way of example, the moving contact 9 is of the rotating type with two arms, each of which is provided with an active surface for coupling/uncoupling with respect to the respective fixed contact 8; clearly, other embodiments for the moving contact 9 can be used in the pole in a manner that is fully equivalent to the one illustrated.

Figure 2:
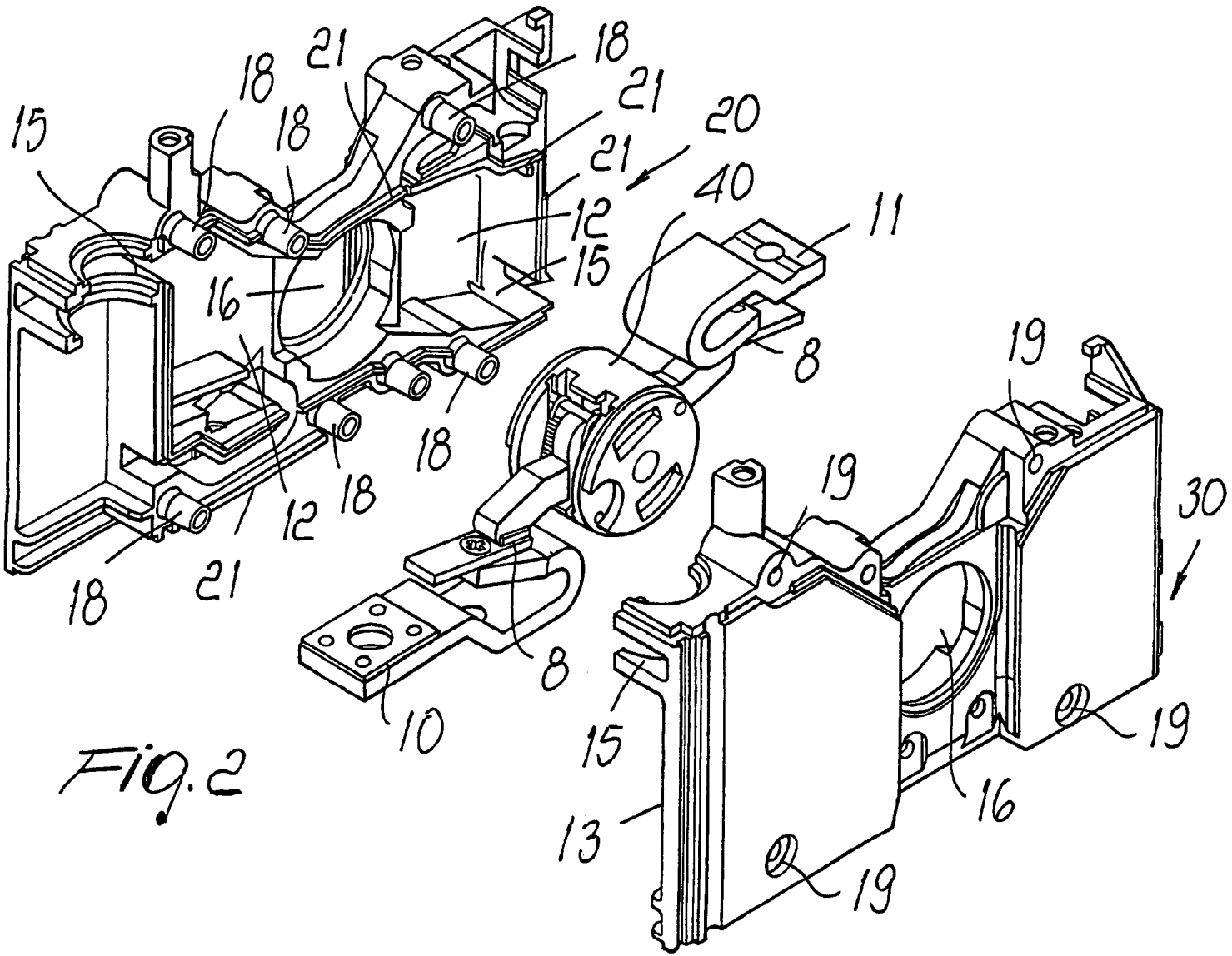
FIG. 2 is a schematic exploded view of an electric pole according to the present invention for a double-break low-voltage power circuit breaker.

As shown in detail in FIGS. 1 and 2, the coupling surfaces of the first half-shell 20 and of the second half-shell 30 are provided with a complementary geometry and have respectively first and second mutual coupling means, which essentially comprise for example protruding edges 21 and corresponding containment slots (not shown in the figure), which are suitable to couple geometrically to each other and ensure the tightness of the first compartment 12 with respect to the ionized gases typically generated in the arc chute following a short circuit. Furthermore, the facing surfaces between the two half-shells are shaped so that when the half-shells are coupled the enclosure 1 has at least one venting channel 15 arranged for example at one end of the arc chute, proximate to the common edge between the upper wall 3 and the front wall 7, and a contoured seat 17 that is arranged along the venting channel 15, for example proximate to the common edge between the upper wall 3 and the front wall 7. Said contoured seat 17 can couple to an insulating means that is configured in a manner that is geometrically complementary thereto, for example a substantially cylindrical hollow element made of synthetic resin, which by coupling to the walls of the seat 17 hinders the passage of the gases from the venting channel 15 into the containment volume 13 in which the terminal 10 is arranged, at the same time allowing front accessibility to the inside of the volume 13 for clamping means of said terminal 10, typically screws.

In the case of a pole 100 of the double-break type, the two half-shells 20 and 30 are shaped so as to form preferably a second venting channel 15, whose delimiting half-walls are visible in FIGS. 1 and 2; said second venting channel is arranged at the second arc chute and is also suitable, like the first channel 15, to allow the outflow of gases outside the pole without interacting with the second terminal 11.

Figure 3:
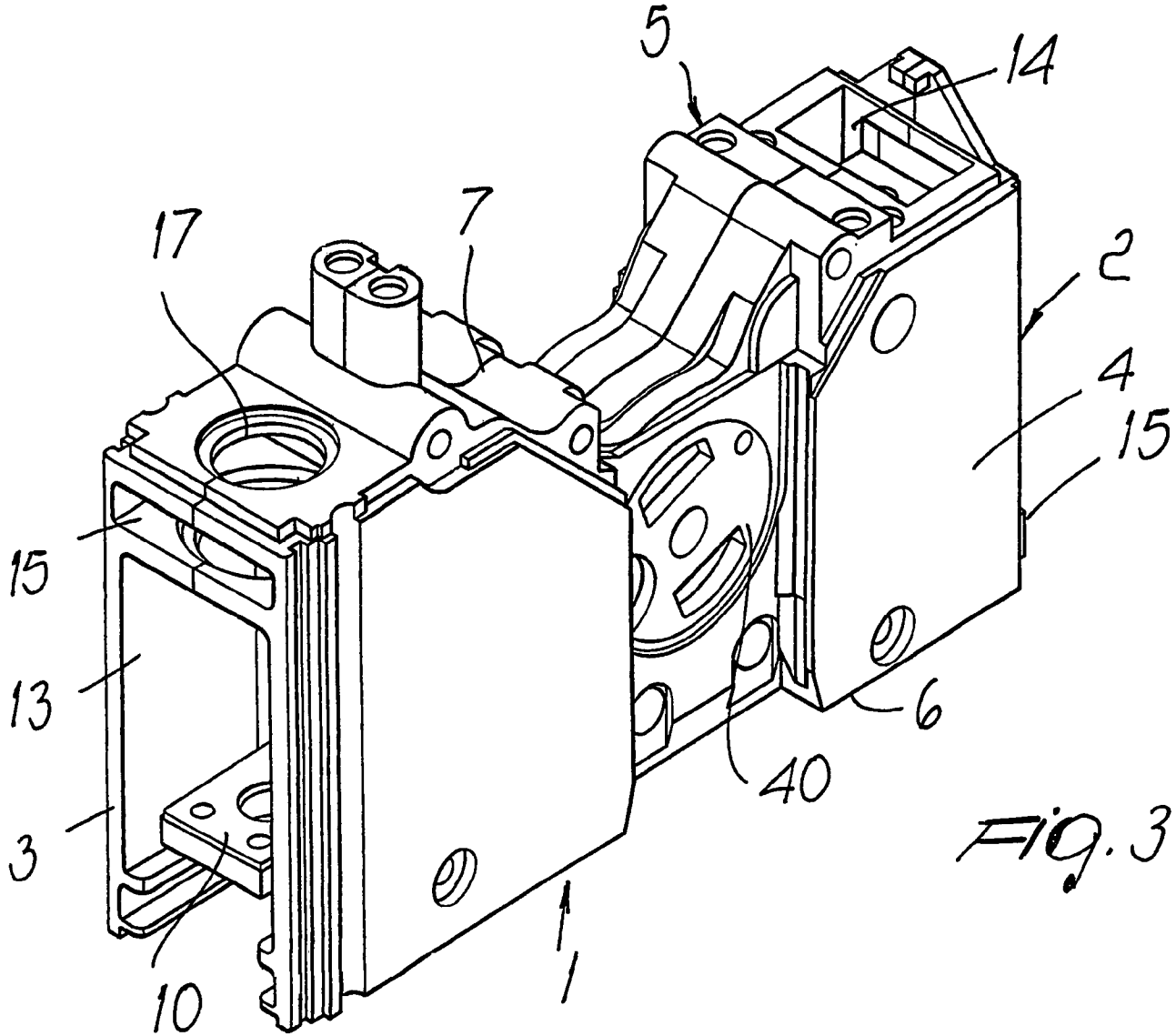
FIG. 3 is a view of the pole of FIG. 2 in the assembled condition.

An opening 16, moreover, is formed in the enclosure 1 in the two side walls 4 and 5 and allows the passage of a switching element, or contact supporting shaft, which in turn is suitable to support and actuate the moving contact 9; FIGS. 1 to 3 illustrate a cross-section of said shaft, designated by the reference numeral 40. Advantageously, in the embodiment of the pole according to the invention, the surfaces for delimiting the opening 16 are shaped so as to allow the relative movement of the shaft 40 with respect to the enclosure and the substantial gas-tightness of the opening 16.

In this manner, in the pole 100 according to the invention the enclosure 1, by virtue of its self-supporting structure, advantageously combines the structural function and the containment function that in the known art are instead performed by two different containers, making it unnecessary to use additional external enclosure means. Furthermore, the particular shape of the half-shells that constitute the enclosure allows the coupling obtained between the pole 100 and the element for supporting and moving the moving contact to provide both the necessary relative mobility and the essential tightness with respect to the gases generated inside the pole, thus avoiding the user of additional closure or sealing elements that close the region where the pole and said shaft 40 couple. Finally, the particular structure with the compartment 12 and the volumes for containing the terminals and the provision of one or more venting channels ensures an adequate electrical insulation among the electrically active parts of the pole, facilitating the escape of the gases out of the enclosure only through said preferential channels, preventing said gases from making dangerous contact with one of the electric terminals.

An extremely advantageous aspect of the pole 100 according to the invention is the fact that on the coupling surfaces of the first and second half-shells 20 and 30 there are also respectively multiple hollow pins 18 that protrude transversely from one of said surfaces and multiple through holes 19, which are provided on the other surface and are suitable to receive the hollow pins 18; in this manner, by virtue of the mutual coupling between the pins 18 and the corresponding holes 19, insulating channels are formed which run transversely to the lateral walls 4 and 5 of the enclosure 1. Preferably, in the illustrated embodiments, the hollow pins 18 and the corresponding holes 19 are formed on the coupling surfaces respectively at the protruding edges 21 and at the respective seats, along the perimeter that delimits the compartment 12 and/or the first containment volume 13 and/or the second containment volume 14; in the specific case, the pins 18 and the holes 19 are arranged respectively along the front wall 7 and the rear wall 6 and therefore do not pass through the regions inside the compartment 12 or the containment volumes 13 and 14.

Figure 4:
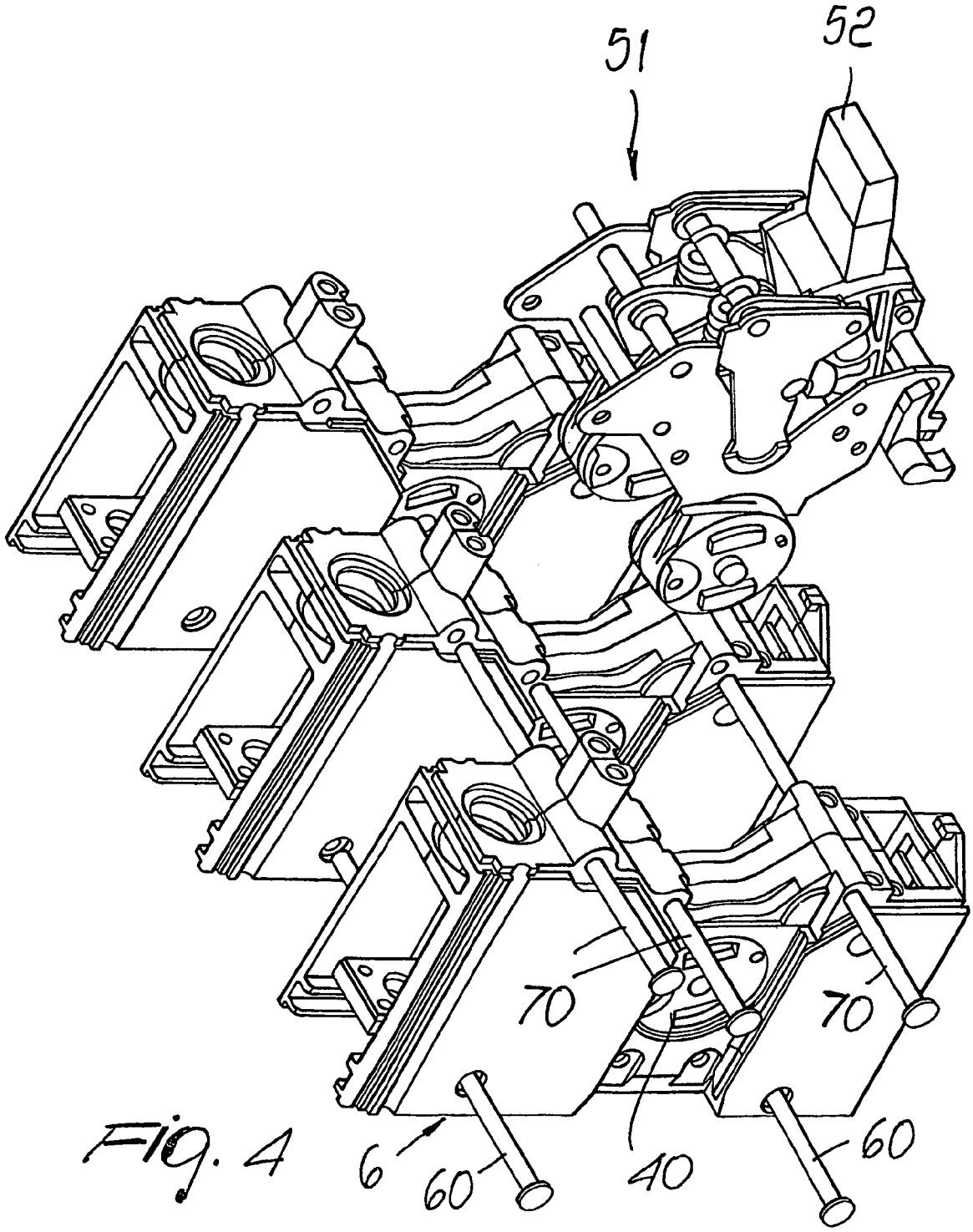
FIG. 4 is a perspective view of a plurality of poles according to the invention during mutual coupling and with the actuation means of a low-voltage power circuit breaker of the three-pole type.
Figure 5:
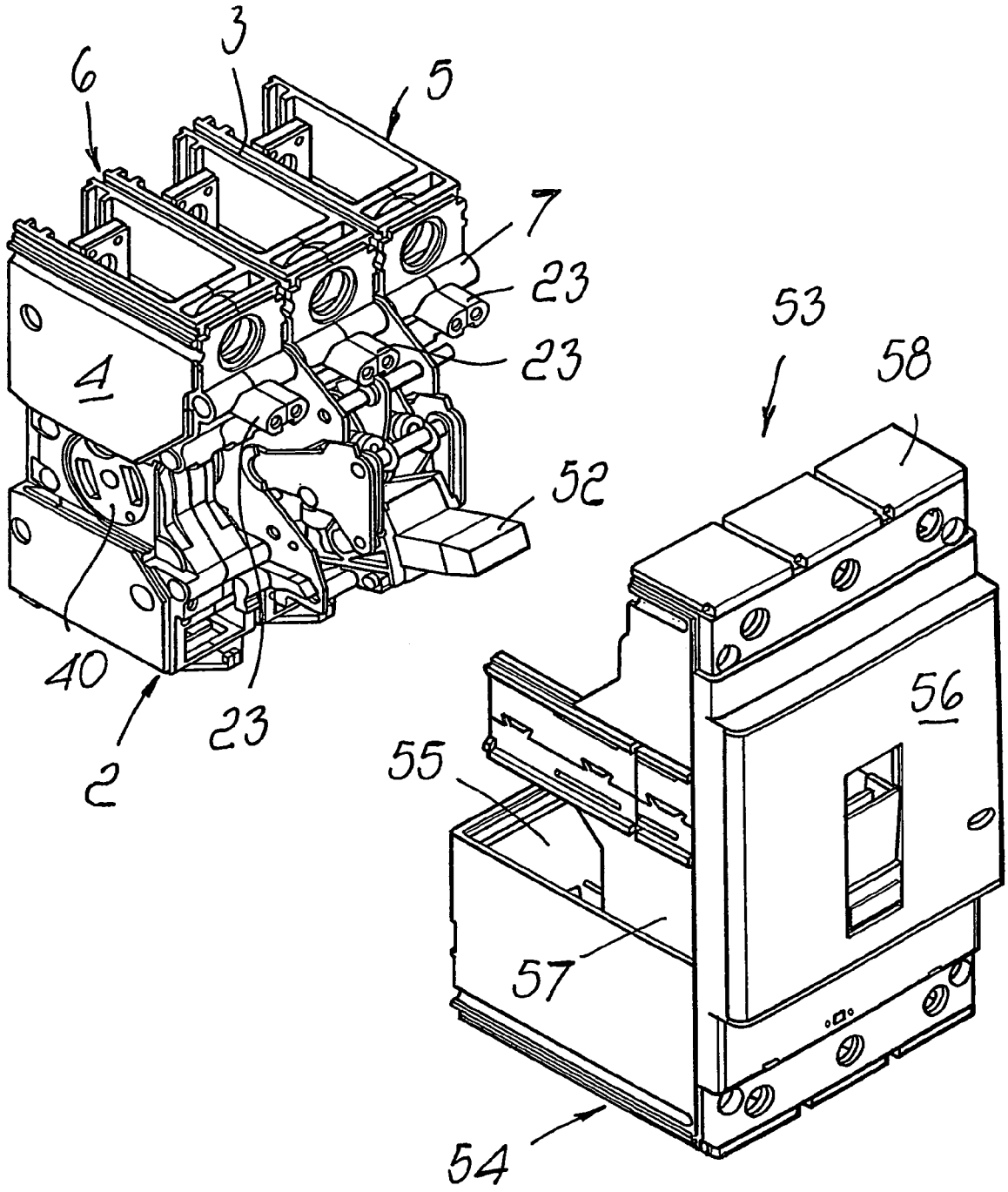
FIG. 5 is a view of the elements of FIG. 3 shown mutually assembled, during coupling to the cover of the circuit breaker.
Figure 6:
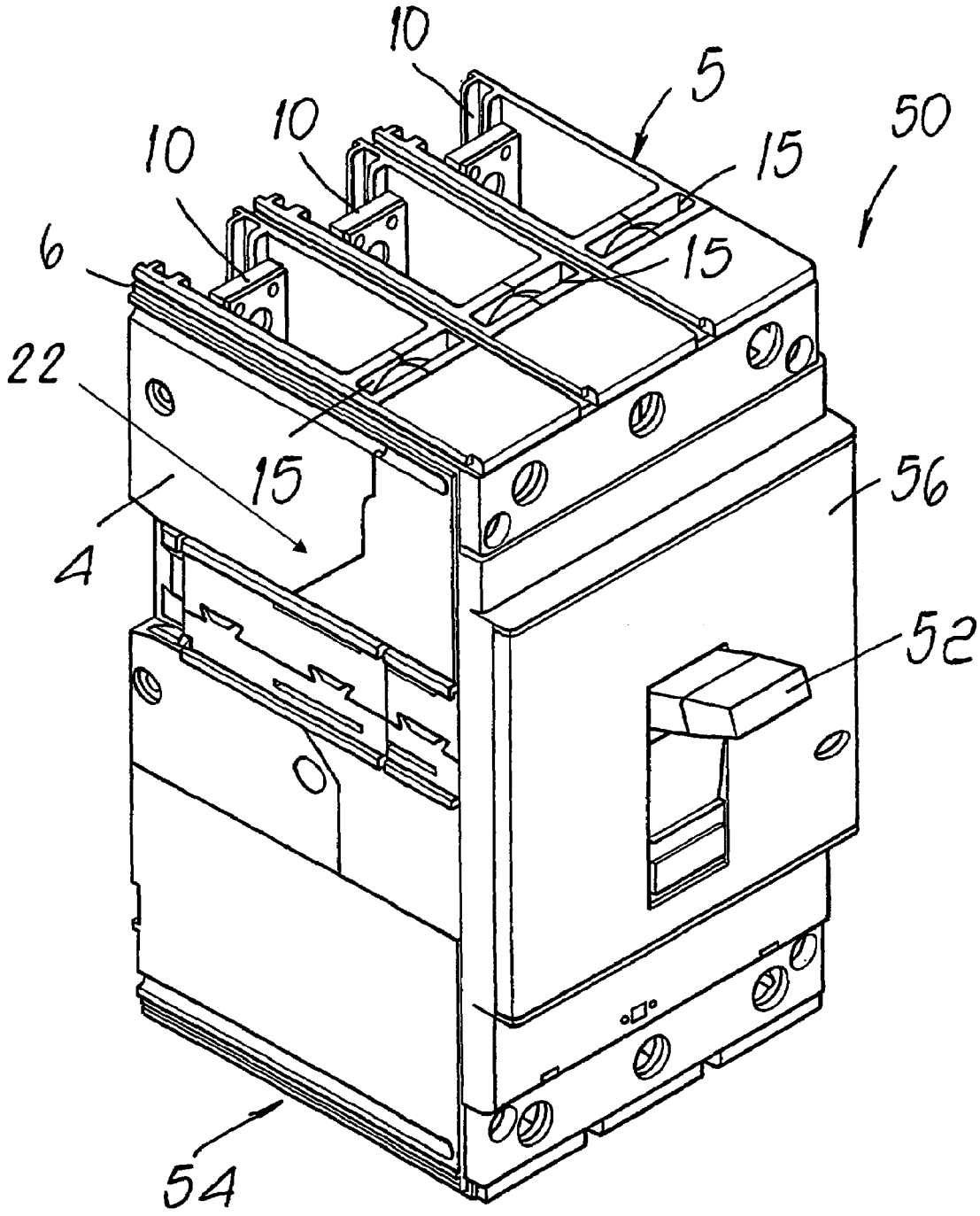
FIG. 6 is a perspective view of the circuit breaker of FIG. 4 after assembly has been completed.

Said through channels make the pole 100 suitable for assembly with additional poles meant to be arranged laterally adjacent and functionally associated therewith, for use in a multipole circuit breaker, according to a constructive solution that is at once extremely simple and effective. An example in this regard is shown in FIGS. 4 to 6, which illustrate a three-pole automatic circuit breaker, generally designated by the reference numeral 50. As shown in FIGS. 4 and 5, according to embodiments that are widely known in the art and therefore are not described in detail, the circuit breaker 50 comprises actuation means 51 provided with an actuation lever 52 that is available to the intervention of an operator, and an actuation element 40 of the type described above for supporting and actuating the moving contacts of each one of the poles used. In the specific case, the illustrated actuation element 40 has a modular structure and is the subject of a copending patent application in the name of the same Applicant; clearly, other embodiments of an actuation element can be used in a functionally equivalent manner. Furthermore, the circuit breaker 50 comprises a shaped insulating cover 53, which generally constitutes the front covering element of said circuit breaker; in particular, in the embodiment shown in FIG. 5, the cover 53 has a first portion 54, which forms the lower part of the enclosure of the circuit breaker 50 and delimits a containment volume 55, for example for the insertion of means for protection against electrical faults such as an electromagnetic relay, and a second portion, which forms the front wall 56 and partially forms the side wall 57 and the upper wall 58 of said circuit breaker.

Advantageously, the interruption section of the circuit breaker 50 is provided by using multiple poles 100 of the type described above, three in the illustrated example, or four for a four-pole automatic circuit breaker, et cetera. In particular, said poles 100 are arranged mutually side by side so as to mutually align the respective openings 16 and the insulating through channels formed by the coupling of the pins 18 with the holes 19; then mutual assembly is performed, by inserting in at least some of the through channels a series of assembly tension elements 60, generally of the metallic type; in particular, the assembly tension elements 60 are preferably coupled to the poles 100 by pressing and are inserted in the through channels formed at the rear wall 6 of said poles. Inside at least some of the remaining insulating through channels, and more specifically in the ones formed at the front wall 7 of the poles, transverse connection elements 70 are inserted which essentially are meant to connect mechanically the poles to the actuation means in a manner similar to the solutions known in the current art.

The resulting block constituted by the poles and the actuation means, with the poles crossed by the contact supporting shaft 40, is then coupled to the cover 53, so that the side walls 4 and 5 and the upper wall 3 and the rear wall 2 of said poles constitute advantageously at least one significant portion of the upper and rear side walls of said circuit breaker, as shown in FIG. 6; in particular, the coupling to the cover 53 is provided by utilizing at least one pin 23 that is provided on the front wall 7 of said enclosure 1 of each pole and protrudes frontally from it; in the illustrated embodiment, for each enclosure there are two pins 23, each of which is arranged on a corresponding half-shell 20 and 30. Furthermore, the enclosure 1 of each pole 100 is shaped so as to have, on the side walls 4 and 5, two recesses 24 formed at the respective through opening 16; depending on the position of the poles 100, said recesses 24 are suitable to accommodate respectively electric cables, when the recess 24 is arranged on the outer side of the circuit breaker, or a section of the element 40 for supporting and moving the moving contact, when the recess 24 belongs to the facing walls of two poles arranged side by side, thus helping to obtain a clean and extremely compact configuration of the circuit breaker. Finally, on the side walls 4 and 5 of the enclosure 1 there are also two splined regions 22 arranged proximate to the upper wall 3 and suitable to allow geometric coupling to a covering element of the electric terminal 10, which has a per se known shape and is therefore not described in detail.

In this manner, one obtains in all a circuit breaker that has a compact and extremely simplified shape, in which the external enclosure means used in the known art are eliminated.

Most of the perimetric walls are in fact constituted by the very walls of the laterally adjacent poles; furthermore, the poles are mutually assembled in an extremely simple manner by virtue of the assembly tension elements 60, which allow a precise coupling among the individual poles 100 and help to ensure the correct rigidity and functionality of the assembly, allowing a solid mechanical coupling and forming the interruption section of the circuit breaker. Furthermore, the insulating through channels, formed by the pins 18 and the holes 19, accommodate substantially completely both the assembly tension elements 60, which do not interfere in any manner with the region for the coupling of the poles and the switching element, and the transverse connection elements 70, insulating them completely without having to resort to additional insulating elements.

In practice it has been found that the pole according to the invention allows to achieve fully the intended aim, providing significant advantages with respect to the known art; in addition to the advantages listed above, it should be noted that the innovative results of the invention are achieved with methods that are relatively easy to implement and at extremely low costs, obtaining at the same time improved reliability, economy and ease of use with respect to known solutions.

The electric pole for low-voltage power circuit breakers according to the invention thus conceived is susceptible of numerous modifications and variations, all of which are within the scope of the inventive concept. All the details may furthermore be replaced with other technically equivalent elements. In practice, the materials used, so long as they are compatible with the specific use, as well as the dimensions, may be any according to the requirements and the state of the art.

The invention claimed is:

1. An electric pole for a low-voltage power circuit breaker, comprising:

an insulating enclosure that has a lower wall, an upper wall, two side walls, a rear wall and a front wall;

at least one arc chute;

at least one fixed contact and at least one moving contact that can be mutually coupled/uncoupled; and a first electric terminal and a second electric terminal that are functionally associated with said fixed contact and said moving contact and allow electrical connection of the pole in input and in output, wherein said insulating enclosure comprises a first half-shell and a second half-shell which are mutually coupled along corresponding coupling surfaces and form a self-supporting structure, said first and second half-shells being shaped so as to form at least one compartment that is suitable to accommodate said fixed contact and said moving contact and said arc chute, and second and third containment volumes, which are arranged on mutually opposite sides with respect to said compartment and are suitable to accommodate respectively said first and second electric terminals, wherein respective first and second coupling means are arranged on and monolithically connected to the coupling surfaces of said first and second half-shells, said first and second coupling means being suitable to couple geometrically to each other so as to form said self-supporting structure.

2. The pole according to claim 1, wherein said first and second coupling means are suitably arranged to ensure tightness of said compartment with respect to any gases generated in the arc chute.

3. The pole according to one of claims 1 or 2, wherein said enclosure has a venting channel that is arranged at the arc chuteand is suitable to facilitate the exit of said gases from the enclosure, and an opening in said two side walls which allows passage of a shaft that supports and moves said moving contact, the surfaces that delimit said opening being shaped so as to allow a relative movement of said element with respect to the enclosure and to provide a tightness of said opening with respect to said gases.

4. The pole according to claim 1, wherein, on the coupling surfaces of said first and second half-shells there are respectively multiple hollow pins that protrude transversely from one of said surfaces and multiple through holes on the other surface which are suitable to receive said hollow pins, the mutual coupling between said pins and the corresponding holes forming insulating channels that pass transversely with respect to the side walls of the enclosure.

5. The pole according to claim 4, wherein said hollow pins and said corresponding holes are formed around a perimeter of one or more of said compartment and said first and second containment volumes.

6. The pole according to claim 1, wherein two corresponding splined regions are formed on the side walls of the enclosure, proximate to said upper wall, and are suitable to allow geometric coupling to an element for covering said first electric terminal.

7. The pole according to claim 1, wherein at least one pin is formed on the front wall of said enclosure so as to protrude frontally from the enclosure and be suitable for coupling to a front covering element.

8. The pole according to one of claims 1 or 2, wherein the side walls of said enclosure have, at a through opening, a recess that is suitable to accommodate electric cables or a section of said element for supporting and moving the moving contact.

9. The pole according to claim 1, further comprising a second arc chute and a second fixed contact; arranged in said compartment, said enclosure comprising a second venting channel that is arranged at said second arc chute.

10. A multi-pole low-voltage power circuit breaker, comprising:

multiple poles as claimed in claim 1;

an actuation lever and an element that supports and moves moving contacts of the circuit breaker;

a contoured insulating cover comprising a first portion that forms a lower pail of the enclosure of the circuit breaker and delimits a containment volume, and a second portion, that forms the front wall and partially forms the side and upper walls of the circuit breaker, wherein the multiple poles are arranged side by side and mutually assembled, wherein at least one portion of the side, upper and rear walls of the circuit breaker comprises the side, upper and rear walls of said multiple poles.

11. The multi-pole circuit breaker according to claim 10, wherein said multiple poles are assembled so that the corresponding insulating through channels are mutually aligned, and wherein tension elements suitable to allow assembly are inserted at least in part of said through channels.

12. The multi-pole circuit breaker according to claim 11, wherein said tension elements are coupled by pressing to said poles.

13. The multi-pole circuit breaker according to claim 11, wherein transverse elements that connect to said actuation lever are inserted in at least part of the remaining insulating through channels.

14. The multi-pole circuit breaker according to claim 10, wherein the multiple poles comprises three poles.

15. The multi-pole circuit breaker according to claim 10, wherein the multiple poles comprise four poles.

16. An electric pole for a low-voltage power circuit breaker, comprising:

an insulating enclosure that has a lower wall, an upper wall, two side walls, a rear wall and a front wall;

at least one arc chute;

at least one fixed contact and at least one moving contact that can be mutually coupled/uncoupled; and a first electric terminal and a second electric terminal that are functionally associated with said fixed contact and said moving contact and allow electrical connection of the pole in input and in output, characterized in that wherein said insulating enclosure comprise a first half-shell and a second half-shell which are mutually coupled along corresponding coupling surfaces and form a self-supporting structure, said first and second half-shells being shaped so as to form at least one compartment that is suitable to accommodate said fixed contact and said moving contact and said arc chute, and second and third containment volumes, which are arranged on mutually opposite sides with respect to said compartment and are suitable to accommodate respectively said first and second electric terminals, wherein said enclosure comprises, at a venting channel, a contoured seat configured to hinder passage of said gases from the venting channel into the first containment volume and to allow front accessibility to the inside of said first containment volume.

* * * * *